US006851172B2

(12) United States Patent
Schmitt

(10) Patent No.: US 6,851,172 B2
(45) Date of Patent: Feb. 8, 2005

(54) METHOD FOR SECURING A ROD-SHAPED PART IN A HOLDING MEMBER

(75) Inventor: Jakob Schmitt, St. Ingbert (DE)

(73) Assignee: Willy Voit GmbH & Co. Stanz- und Metallwerk, St. Ingbert (DE)

( * ) Notice: Subject to any disclaimer, the term of this patent is extended or adjusted under 35 U.S.C. 154(b) by 128 days.

(21) Appl. No.: 10/047,486

(22) Filed: Jan. 14, 2002

(65) Prior Publication Data

US 2003/0133747 A1 Jul. 17, 2003

(51) Int. Cl.[7] ..... B23P 11/00

(52) U.S. Cl. ..... 29/505; 29/516; 29/520; 29/521; 72/367.1; 72/368; 72/370.04; 72/370.25

(58) Field of Search ..... 29/505, 509, 515, 29/516, 520, 521, 525.02, 525.11, 517; 72/365.2, 368, 379.2, 367.1, 370.01, 370.04, 370.25

(56) References Cited

U.S. PATENT DOCUMENTS

| | | | | | |
|---|---|---|---|---|---|
| 1,387,199 | A | * | 8/1921 | Small | 138/171 |
| 1,850,679 | A | * | 3/1932 | Leis | 72/337 |
| 2,317,198 | A | * | 4/1943 | Kasper | 29/521 |
| 3,273,601 | A | * | 9/1966 | Gain | 29/521 |
| 3,371,572 | A | * | 3/1968 | King, Jr. | 29/517 |
| 3,381,156 | A | * | 4/1968 | Johnson | 29/521 |
| 3,418,706 | A | * | 12/1968 | White | 29/521 |
| 3,442,008 | A | * | 5/1969 | Johnson | 29/521 |
| 3,551,999 | A | * | 1/1971 | Gutmann | 29/517 |
| 3,572,891 | A | * | 3/1971 | Longenecker | 29/517 |
| 3,995,870 | A | * | 12/1976 | Hulek | 29/509 |
| 4,083,221 | A | * | 4/1978 | Whitted | 72/405.06 |
| 4,395,900 | A | * | 8/1983 | Saurenman | 29/521 |
| 4,673,321 | A | * | 6/1987 | Herb et al. | 411/40 |
| 6,042,891 | A | * | 3/2000 | Crossingham et al. | 72/365.2 |
| 6,330,739 | B1 | * | 12/2001 | Ito | 29/513 |

FOREIGN PATENT DOCUMENTS

| | | | | |
|---|---|---|---|---|
| DE | 31 45 469 A1 | | 5/1983 | |
| DE | 29 12 033 C2 | | 12/1984 | |
| DE | 41 31 385 C2 | | 4/1994 | |
| DE | 44 35 466 A1 | | 4/1996 | |
| JP | 09273266 A | * | 10/1997 | E04C/5/18 |
| WO | WO 97/21506 | | 6/1997 | |

* cited by examiner

*Primary Examiner*—David P. Bryant
*Assistant Examiner*—Jermie E. Cozart
(74) *Attorney, Agent, or Firm*—Henry M. Feiereisen

(57) ABSTRACT

In a method of securing a rod-shaped part in a surrounding holding member, a flat holding member is fabricated with opposite side edges that are formed with elements configured for interlocking engagement. The side edges of the holding member are bent upwards, and the holding member is then shaped into a cross section in accordance with the cross section of the rod-shaped part. After inserting the rod-shaped part into the holding member; the holding member is press-fitted about the rod-shaped part.

8 Claims, 1 Drawing Sheet

Fig.1a
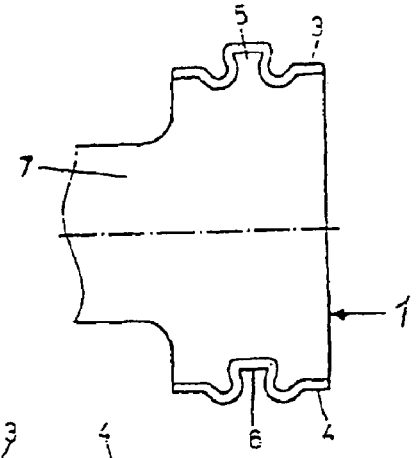
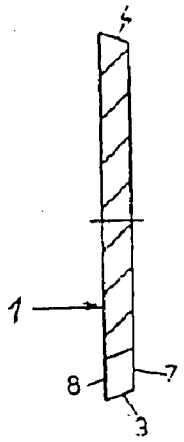
Fig. 1
Fig.1b
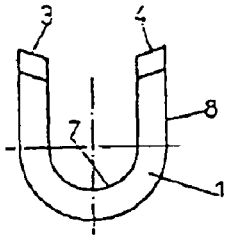
Fig.1c
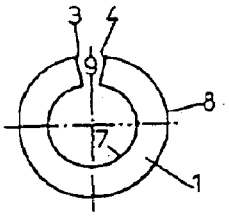
Fig.1d
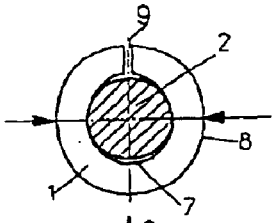
Fig.1e
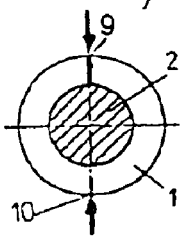
Fig.2
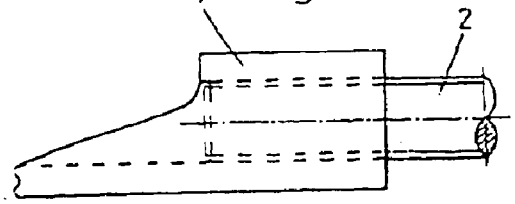

METHOD FOR SECURING A ROD-SHAPED PART IN A HOLDING MEMBER

BACKGROUND OF THE INVENTION

The present invention relates to a method for securing a rod-shaped part in a surrounding holding member. The present invention relates also to a threaded rod secured in a holding member and to the use of such a threaded rod.

Methods of this kind are known. For example, German Pat. No. DE 44 35 466 A1 describes a method for producing a connection between an insert and a tubular part by means of beading. The insert is introduced into the tubular part from one end thereof, pushed along axially and positioned against an axial stop. It is secured against the axial stop through use of a ring-shaped beading tool with which the projecting edge of the tubular part is bent radially inwards with respect to the longitudinal axis of the tubular member. This procedure is relatively time-consuming and expensive, and thus little suited for the manufacture of mass-produced articles.

German Pat. No. DE 41 31 385 A1 describes a method for retaining a component in a pocket, in particular a hollow-cylindrical pocket. Parts of the wall of the pocket are cold-formed by means of a pin in such a manner that the wall material is pressed over the edge of the part. At least two pins are driven at an angle into the sidewall of the pocket, at different places around the circumference thereof. The disadvantage of this method is that the tensile strength is not high enough for all applications.

German Pat. No. DE 29 12 033 A1 describes a method for joining two members by means of a connecting piece. A circumferential groove with recesses in its inner surfaces is formed in the connecting surfaces of the two members to be joined, and the connecting piece then pressed and plastically deformed such that the material flows into the grooves and fills the recesses.

In applications where the tensile strength must be higher than can be achieved simply by pressing, welding offers an alternative method of connecting a rod-shaped part and its holding member. However, welded joints are expensive, and if the parts are coated (e.g. chromatized parts) they are hardly practicable. Screwed connections offer another alternative, but are tedious to produce.

It would therefore be desirable and advantageous to provide an improved method of securing a rod-shaped part in a surrounding holding member, which obviates prior art shortcomings and which is inexpensive and yet attains a connection of high tensile strength between the rod-shaped part and the holding member, while involving a minimum number of parts and also being usable for parts which are already coated.

SUMMARY OF THE INVENTION

According to one aspect of the present invention, a method of securing a rod-shaped part in a surrounding holding member includes the steps of producing a flat holding member provided on two opposite side edges with elements designed to engage positively with each other, bending the side edges of the holding member upwards, shaping the holding member such that its cross section corresponds to the cross section of the rod-shaped part, inserting the rod-shaped part into the holding member, and press-fitting the holding member about the rod-shaped part.

In this way, a connection of very high tensile strength (the connection will withstand tensile loads exceeding two metric tons) is produced between the rod-shaped part and the holding member, which is nevertheless inexpensive to make and can also be used for parts which are already coated (e.g. chromatized parts).

According to another feature of the present invention, the two opposite side edges are beveled towards one side in such manner as to form an inner side with a smaller surface area than that of the outer side. This measure permits a further increase in the tensile strength, especially with small rod-shaped parts, because the holding member embraces the rod-shaped part more closely.

According to another feature of the present invention, the roll forming technique is used to bend the side edges of the holding member upwards and to shape the holding member.

According to another feature of the present invention, at least two pressing operations, executed at 90° relative to each other, are used to form the press-fit between the holding member and the rod-shaped part. The use of two pressing operations executed at an angle to each other produces a better connection between the holding member and the rod-shaped part than is obtained with a single pressing operation.

According to another feature of the present invention, the rod-shaped part may have a radial profile, in particular a thread. Provision of a thread makes it possible to press material of the holding member into the profile of the rod-shaped part, thus improving the connection between the two parts.

According to another feature of the invention, the rod-shaped part may be a threaded rod.

The present invention also relates to a threaded rod which is secured in a holding member and fabricated by a method according to the invention. Also the use of a threaded rod secured in a holding member for adjusting a part should be covered by the present invention.

The method according to the present invention is especially well suited for securing threaded rods in a holding member, since the material of the holding member can flow into the radial profile of the threaded rod during the pressing operation, thereby realizing a positive fit between the two parts. The method can also be used for parts that have already been coated (e.g. chromatized parts), which is of advantage for many applications.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a cross section of one embodiment of a holding member for surrounding retention of a rod-shaped part;

FIG. 1*a* is a plan view of the holding member;

FIGS. 1*b* to 1*e* are various illustrations showing further individual stages of a method of securing the rod-shaped part in the holding member in accordance with the present invention; and FIG. 2 is a side view of the threaded rod secured in the holding member in a manner according to the present invention.

DETAILED DESCRIPTION OF PREFERRED EMBODIMENTS

Throughout all the Figures, same or corresponding elements are generally indicated by same reference numerals.

Turning now to the drawing, and in particular to FIG. 1, there is shown a cross section of one embodiment of a holding member, generally designated by reference numeral 1, for surrounding retention of a rod-shaped part 2 in accordance with the present invention. The holding member 1 has a generally flat configuration and is shaped to size, for example, through blanking. As shown in FIG. 1*a*, the holding member 1 has two opposite side edges 3, 4, formed with interlocking elements in the form of a projection 5 which is engageable in a complementary recess 6. The resulting connection is hereby capable to withstand tensile stress. Of course, additional such elements 5, 6, also in other shapes, may be spaced along the side edges 3, 4.

At least in instances when the rod-shaped part 2 has a small size, it may be advisable to bevel the side edges 3, 4 of the holding member 1 towards one side, so a to form an inner side 7 and an outer side 8, whereby the inner side 7 has a smaller surface area than the outer side 8. In this way, when establishing the connection between the holding member 1 and the rod-shaped part 2, the side edges 3, 4 abut along their entire length to realize a better connection than would be the case when the side edges 3, 4 have a straight configuration.

In a next step, as shown in FIG. 1*b*, the side edges 3, 4 are bent upwards into a U-shaped configuration, for example by roll-forming, such that the inner side 7 faces the inside of the U-shaped holding member 1. Subsequently, as shown in FIG. 1*c*, the holding member 1 is shaped into a cross section which corresponds to the cross section of the rod-shaped part 2. In the non-limiting example shown here, the holding member 1 is shaped into a circular cross-section in correspondence to the circular cross-section of the rod-shaped part 2. The projection 5 engages hereby already the recess 6, so that the cross sectional shape is essentially fixed. At this stage, the cross section of the holding member 1 is still of a size to permit the rod-shaped part 2 to be inserted into the preformed holding member 1 through one of its open ends. This is done once shaping has been completed.

In a next step, as shown in FIG. 1*d*, the rod-shaped part 2 is pressed in a first pressing operation, together with the holding member 1 from the side, i.e., by 90° relative to an opening 9 bounded by the side edges 3, 4; so that the holding member 1 assumes an egg-like shape.

In a second pressing operation, as shown in FIG. 1*e*, which is implemented in 90° offset relationship to the first pressing operation, i.e. in the area of the opening 9 formed by the abutting side edges 3, 4 and in an area 10 opposite to the opening 9. The 90° offset relationship between the first and second pressing operations is indicated by respective arrows in FIGS. 1*d* and 1*e*. As a consequence of the second pressing operation, the opening 9 is closed by flowing material, and a tension-proof connection is realized between the holding member 1 and the rod-shaped part 2.

FIG. 2 shows the threaded rod 2 secured in a holding member 1 in accordance with the invention.

While the invention has been illustrated and described as embodied in a method of securing a rod-shaped part in a surrounding holding member, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. The method of securing a rod-shaped part in a surrounding holding member, comprising the following steps:

fabricating a flat holding member having opposite side edges formed with elements configured for interlocking engagement;

bending the sides edges of the holding member upwards;

shaping the holding member into a cross-section in accordance to a cross section of the rod-shaped part;

inserting the rod-shaped part into the holding member; and press-fitting the holding member about the rod-shaped part to permanently connect the holding member to the rod-shaped part, wherein the press-fitting step includes a first pressing operation at one position of the holding member so that the holding member assumes a non-round configuration, and a second pressing operation at a position offset to the one position by ninety degrees to conform the holding member to the cross section of the rod-shaped part.

2. The method of claim 1, wherein the opposite side edges are beveled towards one side so as to form an inner side and an outer side, with the inner side having a surface area which is smaller than a surface area of the outer side.

3. The method of claim 1, wherein the bending step and the shaping step are implemented by a roll forming operation.

4. The method of claim 1, wherein the rod-shaped part has a radial profile.

5. The method of claim 4, wherein the rod-shaped part has a thread.

6. The method of claim 5, wherein the rod-shaped part is a threaded rod.

7. The method of claim 1, wherein the rod-shaped part has a circular cross section.

8. A method of securing a rod-shaped part in a surrounding holding member, comprising the following steps:

fabricating a flat holding member having opposite side edges formed with elements configured for interlocking engagement;

bending the side edges of the holding member upwards;

shaping the holding member into a cross-section in accordance to a cross section of the rod-shaped part;

inserting the rod-shaped part into the holding member; and press-fitting the holding member about the rod-shaped part to permanently connect the holding member to the rod-shaped part, wherein the opposite side edges are beveled towards one side so as to form an inner side and an outer side, with the inner side having a surface area which is smaller than a surface area of the outer side.

* * * * *

UNITED STATES PATENT AND TRADEMARK OFFICE

CERTIFICATE OF CORRECTION

PATENT NO. : 6,851,172 B2
DATED : February 8, 2005
INVENTOR(S) : Jakob Schmitt

It is certified that error appears in the above-identified patent and that said Letters Patent is hereby corrected as shown below:

Column 4,
Line 14, change “sides” to -- side --.

Signed and Sealed this

Second Day of August, 2005

JON W. DUDAS
*Director of the United States Patent and Trademark Office*